US011591760B2

(12) United States Patent
Allington et al.

(10) Patent No.: US 11,591,760 B2
(45) Date of Patent: Feb. 28, 2023

(54) WIRE ROPE BARRIER

(71) Applicant: TROY WHEELER CONTRACTING LIMITED, Papakura (NZ)

(72) Inventors: Christopher James Allington, Leeston (NZ); Matthew James Bradbury, Waiuku (NZ); Jason Joseph Looij, Christchurch (NZ); Troy Douglas Wheeler, Papakura (NZ)

(73) Assignee: TROY WHEELER CONTRACTING LIMITED, Papakura (NZ)

( * ) Notice: Subject to any disclaimer, the term of this patent is extended or adjusted under 35 U.S.C. 154(b) by 710 days.

(21) Appl. No.: 16/071,803

(22) PCT Filed: Jul. 26, 2016

(86) PCT No.: PCT/NZ2016/050118
§ 371 (c)(1),
(2) Date: Jul. 20, 2018

(87) PCT Pub. No.: WO2017/126979
PCT Pub. Date: Jul. 27, 2017

(65) Prior Publication Data

US 2019/0032292 A1 Jan. 31, 2019

(30) Foreign Application Priority Data

Jan. 22, 2016 (NZ) ..... 716266

(51) Int. Cl.
*E01F 15/06* (2006.01)
*E04H 17/10* (2006.01)

(52) U.S. Cl.
CPC ..... *E01F 15/06* (2013.01); *E04H 17/10* (2013.01)

(58) Field of Classification Search
CPC ..... E01F 15/06; E04H 17/06; E04H 17/10; E04H 17/12; E04H 17/124; E04H 17/24
(Continued)

(56) References Cited

U.S. PATENT DOCUMENTS 383,222 A * 5/1888 Guile ..... E04H 17/10 52/157
504,059 A * 8/1893 Blackburn ..... H01B 17/22 174/172
(Continued)

FOREIGN PATENT DOCUMENTS

EP 1158102 A2 * 11/2001 ..... E04H 17/12
GB 758819 A * 10/1956 ..... H01B 17/145
(Continued)

OTHER PUBLICATIONS

International Search Report, dated Sep. 2, 2016, from corresponding PCT application No. PCT/NZ2016/050118.

*Primary Examiner* — Michael P Ferguson
*Assistant Examiner* — Zachary A Hall
(74) *Attorney, Agent, or Firm* — Nixon & Vanderhye

(57) ABSTRACT

In the above embodiment, the second leg distal end may be shaped to directly enter the slot, the distal end being aligned in a direction parallel and offset relative to the longitudinal cable axis. Also in the above embodiment, the first leg distal end may be shaped as an inverted U-shaped hook, the U-shaped hook being perpendicular and offset relative to the longitudinal cable axis and at least part of the post wall beneath the slot fits within the U-shaped hook once the hanger reaches the final seated position. The end shapes noted above are provided by way of example only and should not be seen as limiting.

21 Claims, 10 Drawing Sheets

(58) Field of Classification Search
USPC ..... 256/13.1, 47, 48, 54
See application file for complete search history.

(56) References Cited

U.S. PATENT DOCUMENTS

| | | | | | |
|---|---|---|---|---|---|
| 1,252,781 | A * | 1/1918 | Clark | E04B 1/41 | 52/714 |
| 1,293,106 | A * | 2/1919 | Jernegan | E04H 17/10 | 256/48 |
| 1,420,140 | A * | 6/1922 | Peleskey | E04H 17/10 | 256/57 |
| 1,510,686 | A * | 10/1924 | Knopke | E04H 17/10 | 256/57 |
| 1,826,182 | A * | 10/1931 | Lee | E04H 17/10 | 256/57 |
| 2,386,129 | A * | 10/1945 | Maack | E04H 17/12 | 248/72 |
| 2,662,740 | A * | 12/1953 | White | E04H 17/10 | 256/48 |
| 3,161,263 | A * | 12/1964 | Stokes | E04H 17/10 | 248/218.4 |
| 3,733,429 | A * | 5/1973 | Berg, Jr. | H01B 17/145 | 174/161 F |
| 3,820,758 | A * | 6/1974 | Berg et al. | A01K 3/005 | 256/10 |
| 4,077,611 | A * | 3/1978 | Wilson | A01K 3/005 | 174/163 F |
| D248,750 | S * | 8/1978 | Langlie | 174/158 F | |
| 4,893,788 | A * | 1/1990 | Chave | A01K 3/005 | 256/47 |
| 5,959,255 | A * | 9/1999 | Langlie | H01B 17/145 | 174/161 F |
| 6,902,151 | B1 | 6/2005 | Nilsson | | |
| 6,948,703 | B2 | 9/2005 | Alberson et al. | | |
| 7,314,137 | B2 | 1/2008 | Rabiea | | |
| 7,968,797 | B2 * | 6/2011 | Williams | A01K 3/005 | 174/154 |
| 8,246,013 | B2 * | 8/2012 | Mauer | E01F 15/06 | 256/48 |
| D669,437 | S * | 10/2012 | Wilson, Jr. | D13/129 | |
| D706,617 | S * | 6/2014 | Hendricks | D8/394 | |
| 8,894,041 | B2 * | 11/2014 | Sachs | E04H 17/12 | 256/57 |
| 2002/0014620 | A1 | 2/2002 | Nilsson | | |
| 2007/0102689 | A1 | 5/2007 | Alberson et al. | | |
| 2010/0090185 | A1 | 4/2010 | Mauer et al. | | |
| 2013/0069026 | A1 | 3/2013 | Bergendahl et al. | | |
| 2013/0207060 | A1 | 8/2013 | Tonks et al. | | |
| 2013/0328000 | A1 * | 12/2013 | Hendricks | E04H 17/10 | 256/10 |
| 2015/0225978 | A1 | 8/2015 | White et al. | | |
| 2015/0299969 | A1 | 10/2015 | James et al. | | |
| 2016/0130775 | A1 * | 5/2016 | Brackin | E01F 15/06 | 256/65.14 |

FOREIGN PATENT DOCUMENTS

| | | | | |
|---|---|---|---|---|
| KR | 101854818 | B1 * | 5/2018 | |
| WO | WO-2005090714 | A1 * | 9/2005 | E04H 17/20 |
| WO | 2007/055792 | A1 | 5/2007 | |
| WO | 2007/129914 | A1 | 11/2007 | |
| WO | 2010/116129 | A1 | 10/2010 | |
| WO | 2012/037607 | A1 | 3/2012 | |
| WO | 2013/039806 | A1 | 3/2013 | |
| WO | 2013/040654 | A1 | 3/2013 | |
| WO | WO-2014032098 | A1 * | 3/2014 | F16L 3/1236 |
| WO | 2014/077701 | A1 | 5/2014 | |
| WO | WO-2014077701 | A1 * | 5/2014 | E01F 15/06 |
| WO | WO-2017086806 | A1 * | 5/2017 | E01F 15/0461 |

* cited by examiner

WIRE ROPE BARRIER

TECHNICAL FIELD

Described herein is a wire rope barrier, sometimes also termed a cable barrier. More specifically, a wire rope barrier is described that uses a cable hanger or hangers that retain a cable against a post yet release the cable from the post in a tuneable and controllable manner when the barrier is subjected to an impact force such as from a vehicle collision.

BACKGROUND ART

Wire rope barriers are used to prevent errant vehicles from impacting road hazards. Such barriers are designed to contain and then redirect any vehicles that impact the barrier without forming a hazard in it's own right, for example, by pushing the vehicle into the path of oncoming traffic. To do this, the barrier must protect the occupants of the vehicle and also not create a danger to other road users.

Barrier designs typically utilise a horizontal elongated tension element, such as tensioned cables, that is/are held at a suitable height via a number of vertical posts. The cables are linked to the posts. When a vehicle hits the barrier, either the vehicle or the lateral displacement created by the cables, force the posts to hinge backwards. The cable position relative to the post may be designed to engage with components on features of the errant vehicle; such as the bumper or headlights. As the posts hinge backwards; the cables must maintain a roughly uniform height during deformation to prevent the cable/cables falling below a critical height on the impacting vehicle where the vehicle may over-run the cables or result in an adverse vehicle motion. To do this, the cable/cables must eventually separate from the posts at least near the proximity of the vehicle if the force of impact or post displacement exceeds a pre-determined level. As the vehicle traverses along the harrier, the posts must separate from the cables just in front of the vehicle. Ideally; all posts upstream of the point: of impact: will remain attached to the cables to assist in maintaining the height of the Cables, however this is not always possible.

The type of barrier used may wiry depending on preferred applications and uses. For example; elongated beam barriers can provide a quicker redirection to the errant vehicle and therefore ensure the vehicle undergoes less deflection or encroachment. These barrier types do however impose greater forces on the occupants inside the vehicle. Wire rope barriers may use 'softer' forms of barrier, such as tensioned cables, which provide lesser forces on the vehicle occupants but with typically an increased barrier deflection and possible encroachment post deflection as the vehicle is redirected.

An example includes U.S. Pat. No. 6,902,151 which is relatively simple to install and has good performance in both directions of impact because the wire ropes are engaged in the centre of the posts (i.e. independent of which direction the posts are impacted all of the wires can push on the post for support). The ability to use different height spacers for the wires makes the system adaptable. The ability to include a steel band to tie the top of the post sections together allows for increased strength as does the ability to include a top cap. This does have drawbacks in that it comprises a lot of different parts and must be installed in the correct order. During an impact the system produces debris. To repair a damaged section of post, all of the wires have to be lifted up and out of the slots which in practice is very difficult without de-tensioning the wires.

U.S. Pat. No. 6,948,703 describes a system specifically designed to work with posts that have holes up one face at 50 mm centres. The locking hook bolts used in the design were created to hold the wire to a post section. The design provides good adjustability of the cable heights up and down the row of holes. The bolts have good strength so hold the wires to the posts but allow the wires to straighten and pull off the posts when needed. The system allows damaged posts to be replaced easily without affecting other undamaged posts. The hook bolts used however are too loose and rock sideways when the wire rope is pulled through them. This pinches the wire to the post and makes it difficult to tension the wires or to release the cables from the post during an impact. The bolts are also clumsy and time consuming to install. From the inventor's experience, the bolts tend to hang take too long before failure occurs hence wire release from the posts is delayed leading to possible loss of vehicle capture and failure of the barrier.

US 2010/0090185 describes an alternative design to the system described in U.S. Pat. No. 6,948,703. The concept is that the cables are forced into the loops on a hook and then the hook is lowered onto the post to sandwich the cables between the hanger and the posts. During an impact the hanger system can slide up the posts and disengage. Alternatively, the cables on the backside of the post can pull away from the post and then snap the arm off the hanger. The steel band is needed to provide additional strength and stiffness to prevent the arms from bending away too quickly. A disadvantage of this system is that to replace a damaged post, all of the cables need to be lifted up and the hanger then removed. This is difficult and most likely requires the wires to be at least partially detensioned. The cables on the backside of the post are not well supported and tend to pull away from the post under an impact load. This produces a weaker system allowing a larger deflection. The cables are also difficult to force into the loops during assembly. Finally, the hanger itself has a large number of tight radius bends which weakens the hanger material about these bends thereby creating zones of weakness in the system. During an impact these zones may fail prematurely.

US2013/0069026 describes a system whereby, as the posts are impacted they hinge backward and allow the cables to pull up vertically through the central slot in the post. Like US 2010/0090185 above, the central slot provides the cables with good support from an impact in either direction. The sawtooth shape of the slot provides resistance to the cables as they are pulled upward, which helps with energy dissipation. It is however necessary to lift all of the cables out of the slots to allow a post to be replaced which is difficult with detensioning. In addition, the pressure from the cables on the fingers of the post (either side of the slot) can cause the fingers to fail early which may result in premature release of the cables.

A variety of other wire rope barrier systems also exist, including but not limited to those described in US2013/0207060, WO2007/055792, WO2010/116129, WO2012/037607, WO2013/039806, U.S. Pat. No. 7,314,137, WO2007/129914 and WO2014/077701. Each system described has advantages and disadvantages typically presenting a compromise between achieving the desired design characteristics whilst minimising parts, easing assembly before and after impact and avoiding damage in-situ premature a vehicle impact.

As should be appreciated from the above, an important aspect is to design the barrier in such a manner that the elongated member is firmly attached to posts during normal (non-impacted use) and, in the event of an impact (crash), the posts move away from the line of movement yet the cables remain at a desired height to catch and re-direct the vehicle. Much of the design work involves how the post and cables are linked and how this linkage is broken in the event of an impact. As noted above, art methods have their drawbacks often to do with difficulties around installation, but also to do with cost of manufacture and installation as well as achieving the desired outcome of vehicle capture and redirection. It may therefore be useful to address at least some of the art drawbacks or at least provide the public with a choice.

Further aspects and advantages of the wire rope barrier will become apparent from the ensuing description that is given by way of example only.

SUMMARY

Described herein is a wire rope barrier that uses a cable hanger or hangers that act to retain a cable against a post yet release the cable from the post in a tuneable and controllable manner when the barrier is subjected to an impact force and displacement such as from a vehicle collision. The hanger comprises two legs, each with a different axis of rotation relative to the post on which the legs are hooked, the result being that the hanger in an impact releases the post from the cable at a predetermined loading and in a controllable and repeatable manner.

In a first aspect, there is provided a wire rope barrier comprising at least one post and at least one cable, each post and cable being linked via at least one hanger wherein the hanger comprises:

(a) a cable holding portion;

(b) at least two legs extending from the cable holding portion, wherein the legs attach to the post in an orientation so that each leg has a different axis of rotation relative to the post.

In a second aspect, there is provided a wire rope barrier comprising a post and at least one cable, the post and cable being linked via at least one hanger wherein the hanger comprises:

(a) a cable holding portion;

(b) at least two legs extending from the cable holding portion, the legs attaching to opposing sides of the post.

In a third aspect, there is provided a wire rope barrier comprising a post and at least one cable, the post and cable being linked via at least one hanger wherein the hanger comprises:

(a) a cable holding portion;

(b) at least two legs extending from the cable holding portion wherein, when a predetermined impact force is imposed on the barrier, at least one hanger releases a retained cable when at least one leg or a part thereof deforms allowing the cable holding portion to in turn release the cable.

As may be appreciated, the above described barrier may provide a variety of advantages. Some examples include:

(a) The barrier achieves the basic requirements of redirecting vehicles and minimising the risk of causing a further hazard by redirection towards other hazards;

(b) The design described minimizes the number of parts necessary—in some embodiments the design might only require the cables, posts and hangers. This therefore reduces expense, complexity, transport costs and makes installation simple and fast;

(c) The design provides for various independent failure modes that can be tuned or tailored to suit the design requirements needed;

(d) Failure on impact is predictable and reproducible as there are few parts and also little for the system as a whole to snag or catch on;

(e) The design minimizes resulting debris post impact thereby minimising additional danger for example to other motorists through loose parts on the road surface;

(f) If the post or posts are structurally sound post impact, the barrier can easily be reassembled by inserting a new hanger;

(g) If a post is damaged during an impact, it can be replaced without needing to touch any other posts in the barrier or de-tension the wire ropes. The hangers are simply removed and the damaged post extracted. A new post is installed and then new hangers used to reattach the cables;

(h) The shape of the hangers positively engages and retains the cables in the hangers. The hangers are also well supported by the post when in a normal position and will only move within a limited design tolerance (in any direction). This allows the cables to be tensioned with all slack in the cables easily drawn through the hangers with no potential for the hangers to disengage, pinch or snag between the hanger(s) and the post(s) during assembly;

(i) The shape of the hanger is locked into place through the interaction with the slots in the post and the gravity weight provided by the cable. This helps keep the hangers securely attached and minimizes the potential for accidental release during an impact or through thermal variations (variations in cable tension with temperature) or vandalism.

(j) The inventors have found that the amount of debris resulting from an impact is low. Few hangers release completely from the posts thereby minimising the additional hazard of flying debris.

BRIEF DESCRIPTION OF THE DRAWINGS

Further aspects of the wire rope barrier will become apparent from the following description that is given by way of example only and with reference to the accompanying drawings in which.

DETAILED DESCRIPTION

Figure 1:
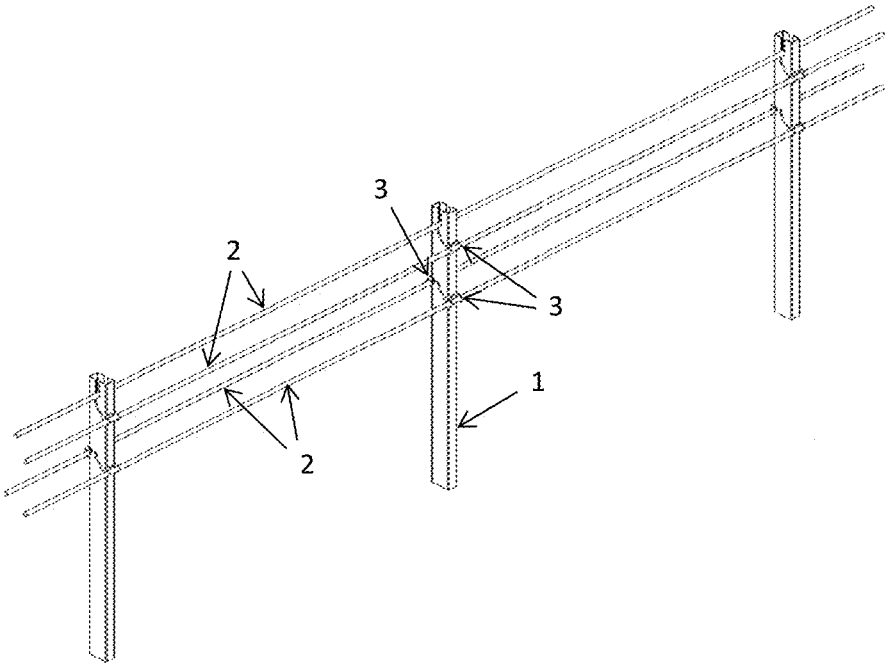
FIG. 1 illustrates a perspective view from above and front of an assembled barrier section with the terminal ends of the barrier removed for clarity.

As noted above, a wire rope barrier is described herein that uses a cable hanger or hangers that act to retain a cable against a post yet release the cable from the post in a tuneable and controllable manner when the barrier is subjected to an impact force and displacement such as from a vehicle collision. The hanger comprises two legs, each with a different axis of rotation relative to the post on which the legs are hooked, the result being that the hanger in an impact releases the post from the cable at a predetermined loading and in a controllable and repeatable manner.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

In a first aspect, there is provided a wire rope barrier comprising at least one post and at least one cable, each post and cable being linked via at least one hanger wherein the hanger comprises:

(a) a cable holding portion;

(b) at least two legs extending from the cable holding portion, wherein the legs attach to the post in an orientation so that each leg has a different axis of rotation relative to the post.

The hangers described herein may support cables on either the front or back of the post relative to the roadside.

Under an impact, cables on the back of the post will want to pull away from the post due to pressure by the vehicle directly on the cables. Under these conditions, the post will also be hinging backwards and folding down towards the ground. As the pressure increases on the rear cables, they will try to force the hangers to rotate away from the post. This will initially be resisted by the varying axes of rotation of the hanger legs. However, when a predetermined load or post rotation is reached, this resistance will be overcome through release of one of the hanger legs, allowing the hanger to rotate.

The shape of the cable holding portion may be such that the cable will be retained in the hanger during the initial stage of rotation, with a tension force being placed on at least one leg back into the post. This tension force ensures the cables are restrained against movement away from the post and works to dissipate energy and reduce the sideways deflection that the vehicle will undergo during a crash. At a predetermined degree of upward rotation the cables will come free of the hangers. This point can be easily tuned, for example by altering aspects of the hangers as described further below. It is important that the cables do come free from the hanger to prevent them from being dragged downward by the posts as they are pushed to the ground.

The hanger legs may be of varying length. The hanger legs may attach to a post at different vertical heights to the post. Since the legs are of varying length and are linked to the post at varying heights, the axis of rotation of each leg varies and hence the hanger will resist pivot movement relative to the post. This configuration provides one way of achieving varied leg rotation axes however this should not be seen as limiting as other methods may be used to achieve varied rotation axes.

The hanger legs, when installed, may link to opposing sides of the post. The post sides may be substantially perpendicular to the cable longitudinal axis.

The cable holding portion of the hanger may be shaped so that it engages a cable about at least two spaced apart locations along the cable longitudinal axis. The engagement locations may coincide or not coincide with the post sides. The engagement locations may for example fall outside the post width or inside the post width. Having at least two locations engaging the cable is an important aspect of the success of the design. If the cable holding portion was a similar design that only hooked onto one side of the post (a 2D shape not 3D) then the cable would only be held to the post by a single leg that is held in-line with the side of the post. Under these conditions, the cable can pinch between the hanger and the side of the post if the post twists sideways during an impact, depending on the direction of the rotation. By using two legs which are spaced apart along the cable longitudinal axis, any rotation of the post will force one of the legs to be pried off the cable which will lift the cable out of the cradle. In the inventor's experience, snagging and catching do not occur with this design.

The cable holding portion of the hanger may have a cradle shape that cups the cable therein. The cradle may have a U-shape cross-section, the cable being seated within the U-shape when assembled. As may appreciated, the cradle shape may be adjusted to alter the timing of release of the cable during rotation of the hanger following leg release. The timing and force required to cause cable release may be adjusted by altering the leg deformation properties. The timing and force required to cause cable release may be adjusted for example by altering the leg length. Alternatively, the timing and force required to cause cable release may be adjusted by altering the way the leg ending and post slot interface. Ways to tailor release and force required are described in more detail below.

In one embodiment, when a predetermined relative lateral rotation between the cable and the post occurs, the cable may be pried out of the cable holding portion and may separate from the post.

In a further embodiment, when a predetermined impact force is imposed on the barrier, the at least one hanger may release a retained cable when the at least one leg or a part thereof deforms and the hanger at least partially detaches from the post.

For the purposes of this specification, the term 'deformation' or grammatical variations thereof refers to a hanger leg or a part thereof bending and/or breaking in response to a predetermined magnitude of force imposed on the barrier. When the impact force on the barrier is sufficiently high, the shorter hanger leg will typically deform first as this will have the greatest loading although aspects of the leg design may be varied to tune deformation to occur on the longer hanger leg first.

The impact force needed to cause deformation of the leg or a part thereof may be predetermined by selection of a leg or part thereof with one or more characteristics of:

(a) a size that deforms at a predetermined loading yet is strong enough to maintain the cable in position on the post when not under an impact load;

(b) a material with a strength or elasticity that deforms at a predetermined loading yet is strong enough to maintain the cable in position on the post when not under an impact load;

(d) a shape of a weaker strength about a particular deformation region that is designed to deform at a predetermined magnitude of impact load;

(e) a material treatment about a particular deformation region that is designed to fail at a predetermined magnitude of impact load.

As may be appreciated from the above, the exact timing of bending or breaking of the deformable legs or a part thereof may be tailored via many factors as noted above. Tailoring (or tuning) of the force needed to cause deformation may be useful for example to ensure all required standards are met in terms of a light vehicle or heavy vehicle impact load and to ensure the hanger does not fail prematurely when not subjected to an impact load.

In the event of an impact on the barrier, subsequent upward movement of a cable or cables relative to the post may urge the cable holding portion of the hanger to rotate. Upward vertical movement (being relative to the posts) may be caused by hinging or rotating movement of the posts. As noted above, under impact from an errant vehicle the posts will bend backwards which will cause the cables to want to move upward relative to the post. The cables on the front of the posts will get pushed up the face of the post and be squeezed out of the gap between the hanger and the face of the post, prying out the cable with the desired release force. The fact that the cable holding portion supports the cable at two spaced apart engagement points allows an increased holding force to be achieved for a small holding region size or material size. This may make the release force highly tuneable.

The vertical load resistance of the hanger or a part thereof prior to deformation occurring may be lower than the horizontal load resistance of the hanger prior to deformation occurring. Analysis of the wire rope barrier and post interaction during a crash test completed by the inventors has shown that, by having a lower vertical release load, cables are able to release from the hanger as the post rotates backwards from the impact force of a vehicle. This avoids the potential for a wire rope to be dragged down by the post which could result in loosing contact with and control of the errant vehicle.

The hanger may at least in part be an elongated shaped rod. Essentially the hanger may be formed at least in part from a wire. The wire in this case may be a rod with a diameter sufficient to achieve the desired loadings and deformation characteristics wanted. The inventor's have found that it is possible to form the entire hanger from a single elongated length of rod or wire thereby minimising materials needed and minimising manufacture time—the rod is simply bent into shape.

The hanger, when attached to the post, may be able to move at least partially relative to the post to allow for varying cable orientations relative to the post orientation. The slot or slots in the post may be sized to have some degree of tolerance so that the hanger, when disposed in the post slot or slots, may be able to move relative to the post to some extent so as to allow some play in the cable position relative to the post. For example, the cable may be moving around a road bend hence does not sit completely flat against the post surface. Tolerance movement noted may be primarily rotational (about a vertical axis) but could be vertical up and down movement, side to side movement, or rotational about a horizontal axis.

The post may have slots that receive the legs or a part thereof. The term slots is used in a broad sense with various configurations possible including holes, apertures, indents, elongated openings and other forms of slot that enable the hanger to be attached to the post.

The slots in the post may be located on the sides of the posts—that is the slots are not at the post front or back, post sides being substantially perpendicular to the cable longitudinal axis and post front being the side closest to the road, post back being furthest away from the road.

Attachment about the post sides, a slots in the post sides ensures that the post strength in the strong axis of bending (perpendicular to the barrier) is not significantly affected by the formation of the slots. This may be useful to maintaining post integrity. The slots, cut into the sides of the post will reduce the strength and stiffness in the weak direction of loading (along the barrier) which may be useful to encourage post failure in this direction when impacted by a vehicle. Slots cut into the front and back face of the post to support the cables may reduce the strength of the post in the strong axis leading to possible failure of the posts at these weakened points.

In one embodiment, at least one leg may have a hook element at one distal end. The hook element may be formed from the whole leg, a substantial part of the leg or a smaller end portion of the leg. Typically it is envisaged that if a hook is used, it will be located towards a distal end of the leg or legs.

In one embodiment, one post slot may be shaped to allow a first hanger leg to enter the slot directly into the post side and the opposing slot may be shaped to allow the second hanger leg to enter the slot via a keyed pathway, initially in a horizontal plane, and subsequently in a substantially vertical plane, until reaching a final seated position in the slot. The longer leg may be the first hanger leg and the shorter leg may fit the keyed slot. This keyed or cam pathway into the slot may be useful to ease installation since it avoids placing any stress or strain on the hanger or legs. Once fully inserted as noted above, the cable holding portion or cradle linked to the legs may lie in a substantially flat horizontal plane commensurate with the natural lie of the cable along the posts.

In the above embodiment, the first leg distal end may be shaped to directly enter the slot, the distal end being aligned in a direction parallel and offset relative to the longitudinal cable axis. Also in the above embodiment, the second leg distal end may be shaped as an inverted U-shape hook, the U-shape being parallel and offset relative to the longitudinal cable axis and at least part of the post wall beneath the slot fits within the U-shape once the hanger reaches the final seated position. The end shapes noted above are provided by way of example only and should not be seen as limiting.

Fitting a cable to the post via the hanger may be completed without tools. The above described design does not include any fasteners for assembly and the parts simply fit together by hand and hence can be assembled without tools.

In a second aspect, there is provided a wire rope barrier comprising a post and at least one cable, the post and cable being linked via at least one hanger wherein the hanger comprises:

(a) a cable holding portion;

(b) at least two legs extending from the cable holding portion, the legs attaching to opposing sides of the post.

In a third aspect, there is provided a wire rope barrier comprising a post and at least one cable, the post and cable being linked via at least one hanger wherein the hanger comprises:

(a) a cable holding portion;

(b) at least two legs extending from the cable holding portion wherein, when a predetermined impact force is imposed on the barrier, at least one hanger releases a retained cable when at least one leg or a part thereof deforms allowing the cable holding portion to in turn release the cable.

As should be appreciated, multiple hangers corresponding to multiple cables may be fitted on each post. Where multiple hangers and cables are used, the cables and hangers may be located at varying heights along the post.

The post may take various forms noting the requirement above of opposing sides. In one embodiment, the post may be a steel box section or alternatively may have a U-shape or H-shape cross-section. The post may be embedded in a plastic socket that mates with a plastic box, the box being located within a concrete support base. Alternatively, the post may be driven into the ground.

The post may have generally upright/vertical position once installed. The barrier may have posts located at approximately 1, or 2, or 3, or 4, or 5, or 6, or 7, or 8, or 9, or 10, or 11, or 12, or 13, or 14, or 15 metre intervals along the barrier length.

The overall barrier length may be varied to suit the end application. The barrier as a whole may have terminating ends. The terminating ends may be of varying design to the wider barrier configuration.

The barrier cables may follow a generally horizontal alignment typically following the road contours and having a constant height above the road commensurate with where a vehicle might impact the cables.

To assemble the barrier, the post is installed separately, the cable or cables are then lined up alongside the posts and may be given some light tension. Each cable may then be placed in the hanger and the hanger then attached to the post. Once all the hangers have been fitted to all of the posts, the cable(s) can then be fully tensioned.

As should be appreciated, installation is relatively simple and as noted above, can be completed quickly and without use of tools except those which may be needed to set the posts. This simple method avoids damage on installation as the cables and hanger(s) are fitted after post installation. No or minimal tension exists on the parts prior and/or during hanger fitting thereby easing the installation process. Further, damage to the top of a post, as may often occur during installation, does not impact on the performance of the barrier design described herein. Art barriers often can become compromised when damage occurs to the top of the post.

As may be appreciated, the above described barrier may provide a variety of advantages. Some examples include:

(a) The barrier achieves the basic requirements of redirecting vehicles yet not redirecting too far or in a way that increases the risk of causing a further hazard;

(b) The design described minimizes the number of parts necessary—in some embodiments the design might only require the cables, posts and hangers. This therefore reduces expense, complexity, transport costs and makes installation simple and fast;

(c) The design provides for various independent failure modes that can be tuned or tailored to suit the design requirements needed;

(d) Failure on impact is predictable and reproducible as there are few parts and also little for the system as a whole to snag or catch on;

(e) The design minimizes resulting debris post impact thereby minimising additional danger for example to other motorists through loose parts on the road surface;

(f) If the post or posts are structurally sound post impact, the barrier can easily be reassembled by inserting a new hanger;

(g) If a post is damaged during an impact, it can be replaced without needing to touch any other posts in the barrier or de-tension the wire ropes. The hangers are simply removed and the damaged post extracted. A new post is installed and then new hangers used to reattach the cables;

(h) The shape of the hangers positively engages and retains the cables in the hangers. The hangers are also well supported by the post when in a normal position and will only move within a limited design tolerance (in any direction). This allows the cables to be tensioned with all slack in the cables easily drawn through the hangers with no potential for the hangers to disengage, pinch or snag between the hanger(s) and the post(s) during assembly;

(i) The inventors have found that the amount of debris resulting from an impact is low. Few hangers release completely from the posts thereby minimising the additional hazard of flying debris.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as of individually set forth.

WORKING EXAMPLES

The above described wire rope barrier is now described by reference to specific examples.

Example 1

Figure 2:
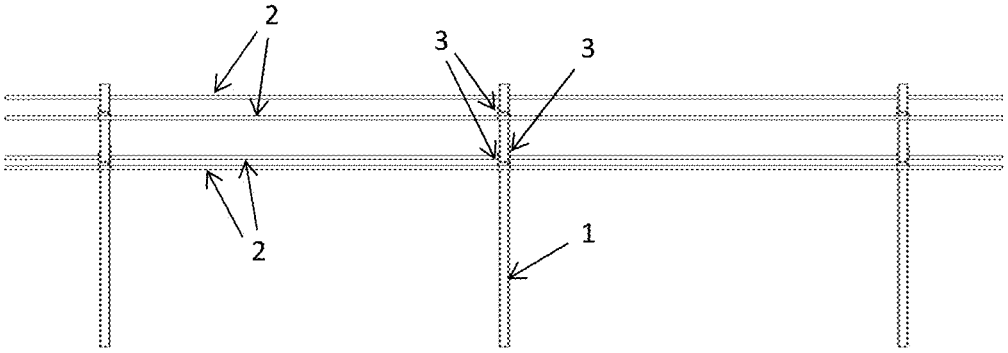
FIG. 2 illustrates a front elevation view of an assembled barrier section with the terminal ends of the barrier removed for clarity.
Figure 3:
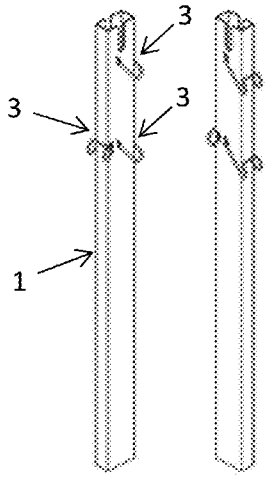
FIG. 3 illustrates two alternate angle detail perspective views of a post and hangers in an assembled position with the cables removed for clarity.
Figure 4:
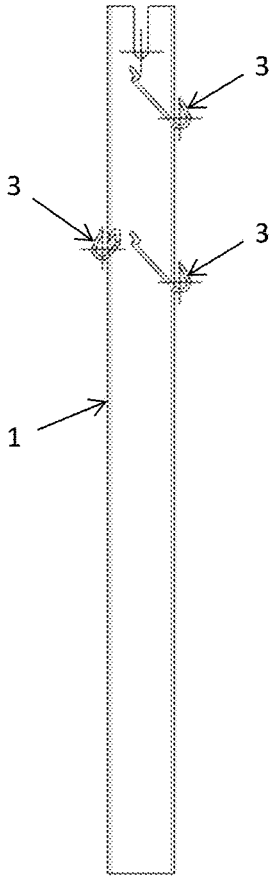
FIG. 4 illustrates a detail front elevation view of a post and hangers in an assembled position with the cables removed for clarity.
Figure 5:
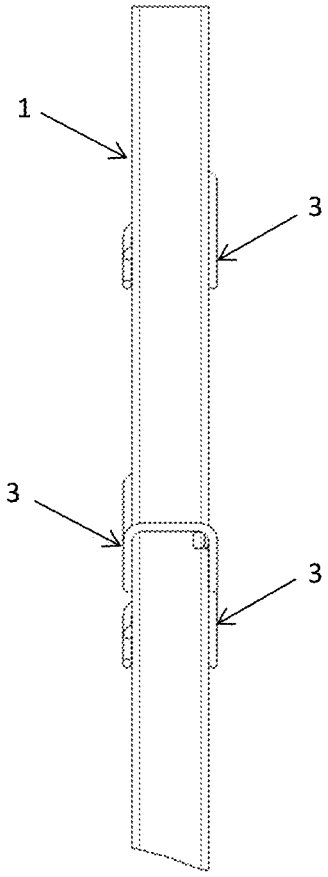
FIG. 5 illustrates a detail side elevation view of a post and hangers in an assembled position with the cables removed for clarity.
Figure 6:
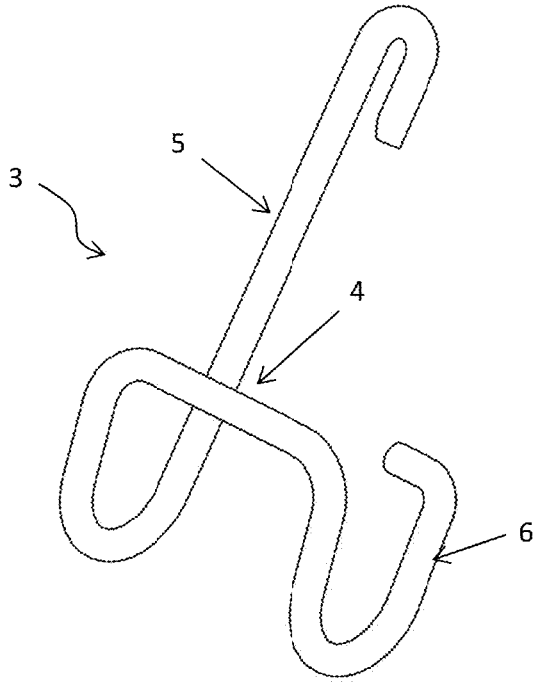
FIG. 6 illustrates a perspective view of a hanger.
Figure 7:
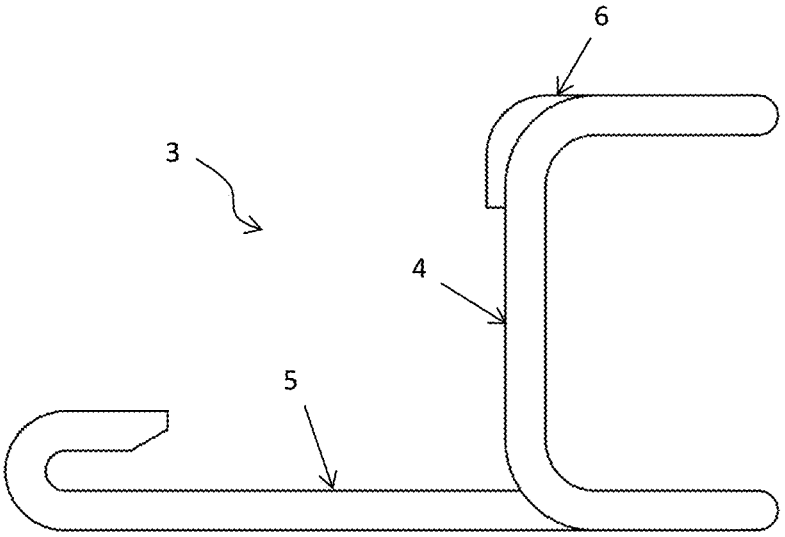
FIG. 7 illustrates a front elevation view of a hanger.
Figure 8:
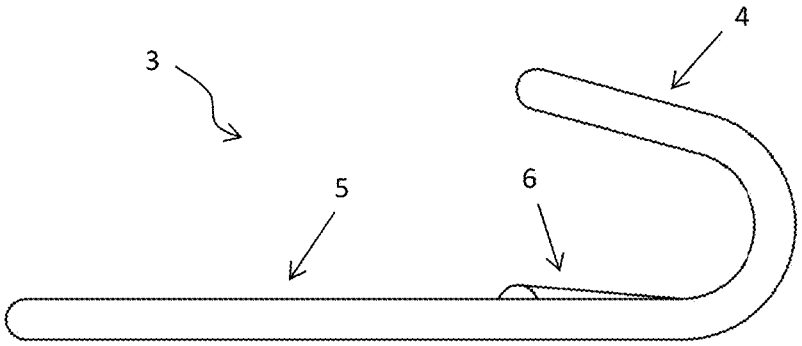
FIG. 8 illustrates a side elevation view of a hanger.
Figure 9:
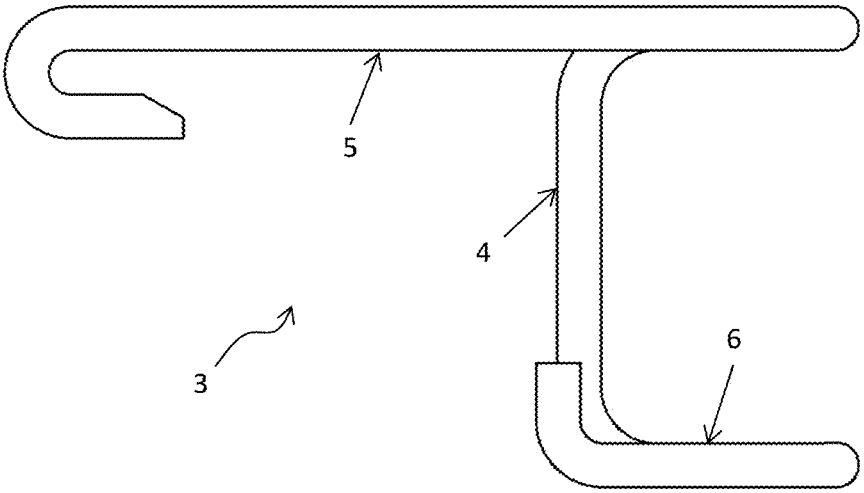
FIG. 9 illustrates a rear elevation view of a hanger.

An assembled wire rope barrier according to one embodiment is shown in FIGS. 1 and 2. The post and hanger in an assembled form is shown in FIGS. 3 to 5. FIGS. 6 to 9 show detail views of the hanger itself.

The barrier comprises posts 1 and cables 2, and the posts 1 and cables 2 are linked via hangers 3.

The hanger 3 comprises a cable holding portion 4 that has a cradle shape and two legs 5 and 6 extending from the cable holding portion 4. The legs 5 and 6 attach to the post 1 in an orientation so that each leg 5 and 6 has a different axis of rotation relative to the post 1.

As shown in the assembled Figures, the hangers 3 support cables 2 on either the front or back of the post 1 relative to the roadside.

The cradle shape of the cable holding portion 4 retains the cable 2 during the initial stage of rotation, with a tension force being placed on at least one leg 5 and 6 back into the post 1. This tension force ensures the cables 2 are restrained against movement away from the post 1 and works to dissipate energy and reduce the sideways deflection that the vehicle will undergo during a crash.

The hanger legs 5 and 6 have varying lengths.

The hanger legs 5 and 6 attach to a post 1 at different vertical heights along the post 1 vertical axis.

Since the legs 5 and 6 are of varying length and are linked to the post 1 at varying heights, the axis of rotation of each leg 5 and 6 varies and hence the hanger 3 will resist pivot movement relative to the post 1.

The hanger legs 5 and 6, when installed, link to opposing sides of the post 1.

The cable holding portion (cradle) 4 is shaped so that it engages a cable 2 about two spaced apart locations along the cable 2 longitudinal axis. By having two engagement points along the cable 2 longitudinal axis, rotation of the post 1 will force one of the hanger legs 5 and 6 to be pried off the cable 2 which will in turn tend to cause the cable 2 to lift out of the cradle.

The cradle has a U-shape cross-section, the cable 2 being seated within the U-shape when assembled.

The entire hanger 3 as shown in the Figures is formed from a single elongated length of rod or wire thereby minimizing materials needed and minimizing manufacture time—the rod is simply bent into shape.

The post 1 has slots 7 and 8 that receive the legs 5 and 6 or a part thereof. One post slot 7 is shaped to allow a first hanger leg 5 to enter the slot 7 directly into the post 1 side and the opposing slot 8 is shaped to allow the second hanger leg 6 to enter the slot 8 via a keyed pathway, initially in a horizontal plane, and subsequently in a substantially vertical plane, until reaching a final seated position in the slot 8. The longer leg 5 is first fitted into slot 7 and the shorter leg 6 is subsequently fitted into the keyed slot 8. Once fully inserted as noted above, the cable holding portion 4 or cradle linked to the legs 5 and 6 may lie in a substantially flat horizontal plane commensurate with the natural lie of the cable 2 along the posts 1.

The hanger 3, when attached to the post 1, may be able to move in the slots 7 and 8 relative to the post 1 to allow for varying cable 2 orientations relative to the post 1 orientation. Tolerance movement noted may be primarily rotational (about a vertical axis) but could be vertical up and down movement, side to side movement, or rotational about a horizontal axis.

Multiple hangers 3 are used in the barrier shown in the Figures corresponding to multiple cables 2 fitted on each post 1 located at varying heights along the post 1.

The post 1 may take various shapes, an example shape being that shown in the Figures of a steel box section. The post 1 may be embedded in a plastic socket that mates with a plastic box, the box being located within a concrete support base (not shown).

Example 2

Figure 10A:
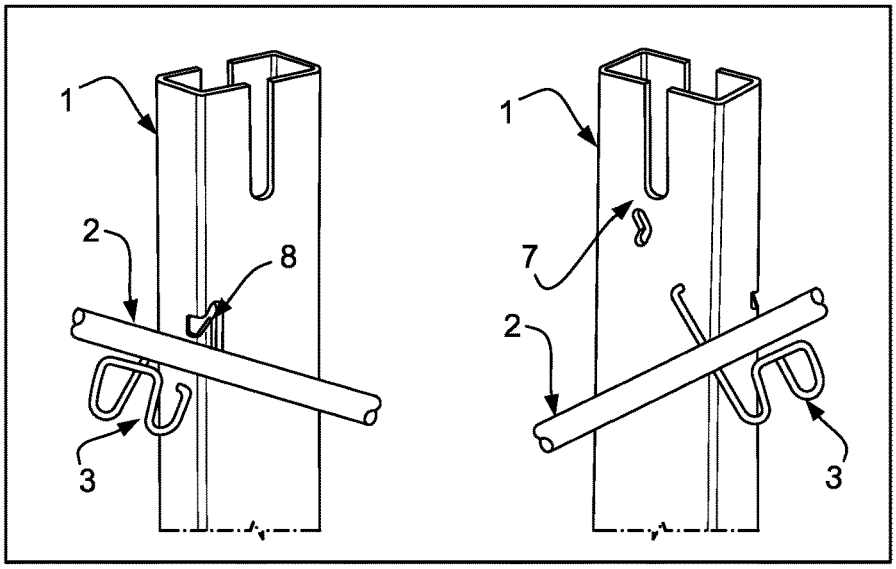
FIG. 10 illustrates in FIGS. 10A, 1013 and 10C, the steps taken to install the wire rope barrier.
Figure 10B:
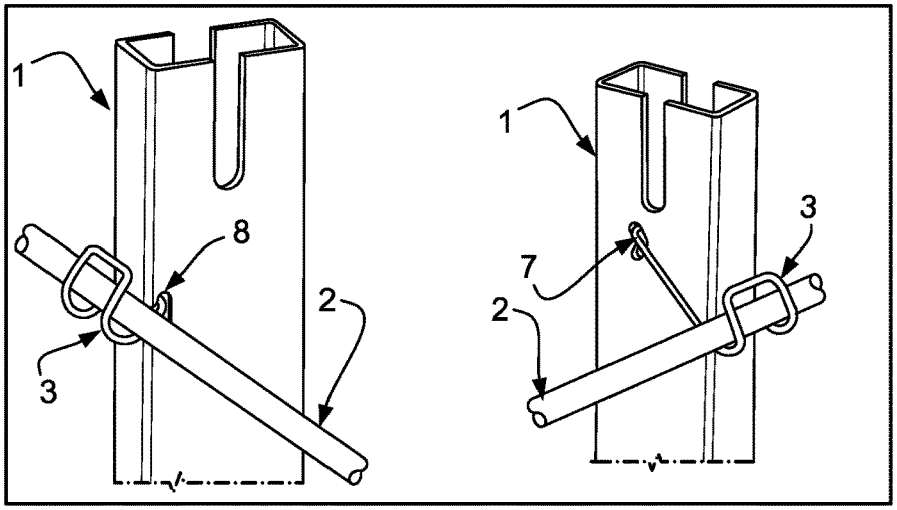
Figure 10C:
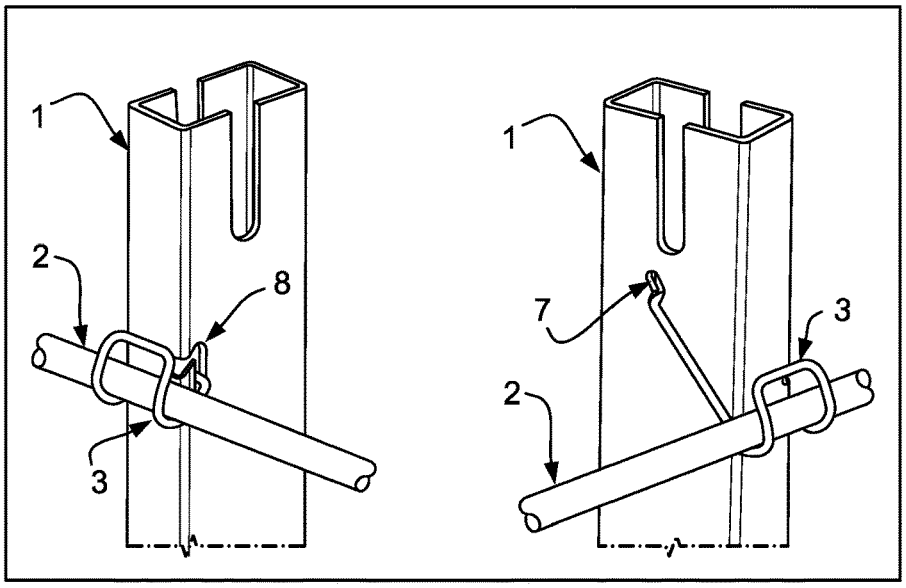

Fitting a cable 2 to the post 1 via the hanger 3 may be completed without tools. Referring to FIGS. 10*a* to 10*c*, to assemble the barrier, the post 1 is installed separately, the cable or cables 2 are then lined up alongside the posts 1 and may be given some light tension. Each cable 2 may then be placed in the hanger 3 and the hanger 3 then attached to the post 1. Once all the hangers 3 have been fitted to all of the posts 1, the cable(s) 2 can then be fully tensioned.

Example 3

Figure 11:
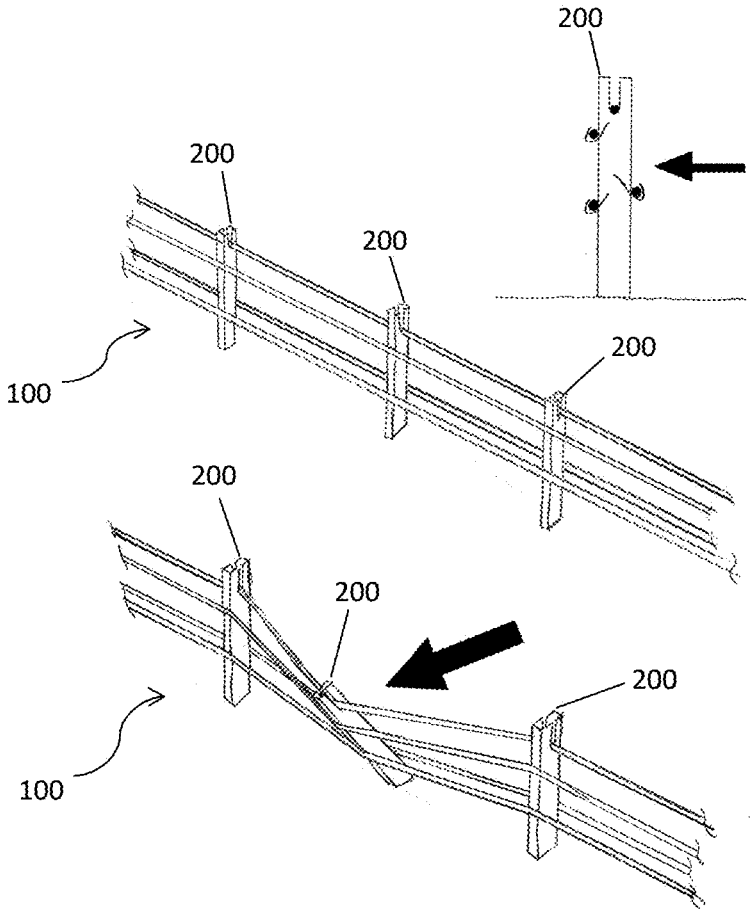
FIG. 11 illustrates a stylised sketch of the barrier and movement of the parts according to an impact scenario.
Figure 12:
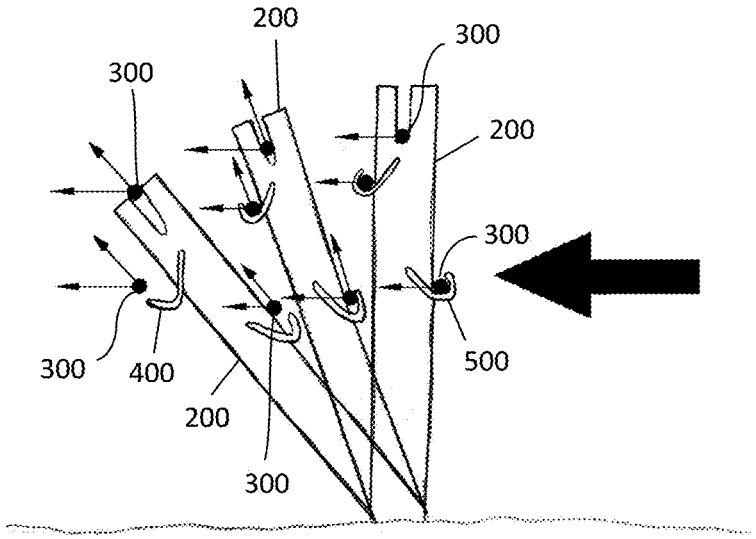
FIG. 12 illustrates a post from side on showing the movement and forces that occur during an impact.

FIG. 11 and FIG. 12 show how the assembly reacts under an impact. In all images, the large black arrow indicates a force from an errant vehicle impacting the barrier 100. For the post 200 rotation image (FIG. 12) the bottom cable and hanger are omitted for clarity. The key item to note, particularly in FIG. 12, is the cables 300 and hanger 400 and 500 positions as the post 200 rotates. The small arrows in FIG. 12 indicate the force vectors for each cable 300. The hangers 400 on the face opposite to the applied force have to open up requiring a larger force (e.g. 5 kN), the hangers 500 on the impact side do not deform as much, the wire rope 300 slides up the post 200 and out the top of the hangers 400 and 500 requiring less force (say 1 kN) and allows the wire rope 300 to maintain its height during an impact and not get dragged down as the post 200 rotates.

Example 4

The ability of the barrier shown in the above Figures to withstand a vehicle impact and redirect vehicles was tested.

The objective of the studies completed was to evaluate the performance of the above described barrier to the requirements of Test Level 4 as detailed in the Manual for Assessing Safety Hardware (MASH) 2009. Recommended tests to evaluate performance are defined for three different test levels. Test Level 4 (TL-4) is conducted at 100 km/h and considered representative of the typical maximum allowable speed on high-speed arterial highways.

Three tests were completed as per the MASH Test Level 4 recommended matrix for longitudinal barriers length of need (LON), namely:

[1] Test 4-10 utilising an 1100 kg car impacting the test article at 100 km/h and an impact angle of 25°;

[2] Test 4-11, utilising a 2270 kg pick-up impacting the test article at 25° while traveling at 100 km/h; and

[3] Test 4-12 using a 10,000 kg single unit truck travelling at 90 km/h and impacting the barrier with an approach angle of 15°.

In all tests, the barrier successfully contained and redirected each test vehicle. No debris or detached elements penetrated or showed potential to penetrate the occupant compartment. No fragments were distributed outside of the vehicle trajectory and therefore did not present any undue hazard to other traffic, pedestrians or work zone personnel. The vehicle in each test remained upright during and after the impact. Occupant risk factors satisfied the test criteria and the vehicle exit trajectory remained within acceptable limits.

Figure 13:
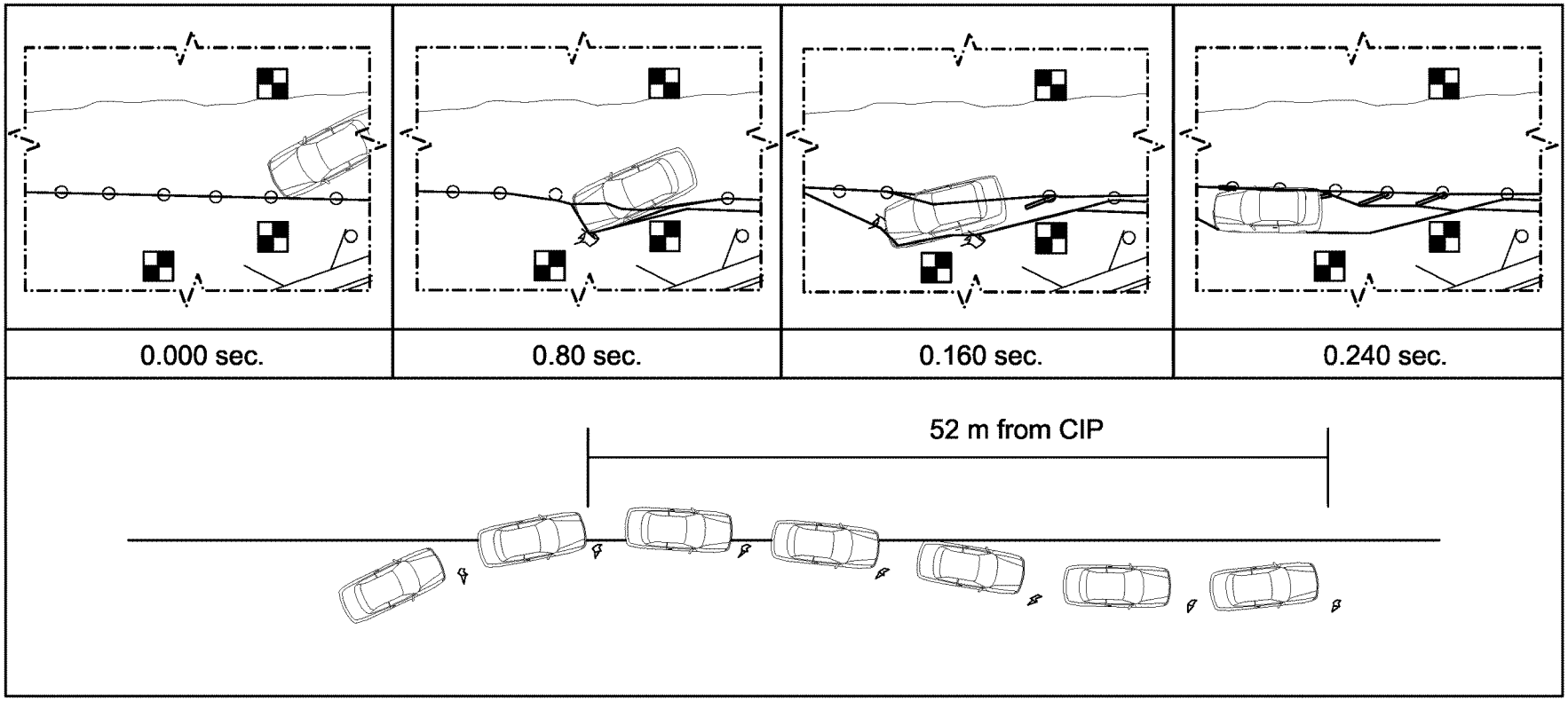
FIG. 13 shows images of the impact and vehicle path of travel in a test using a 1100 kg vehicle.

Images of the impact and vehicle path of travel for Test 4-10 are shown in FIG. 13.

Figure 14:
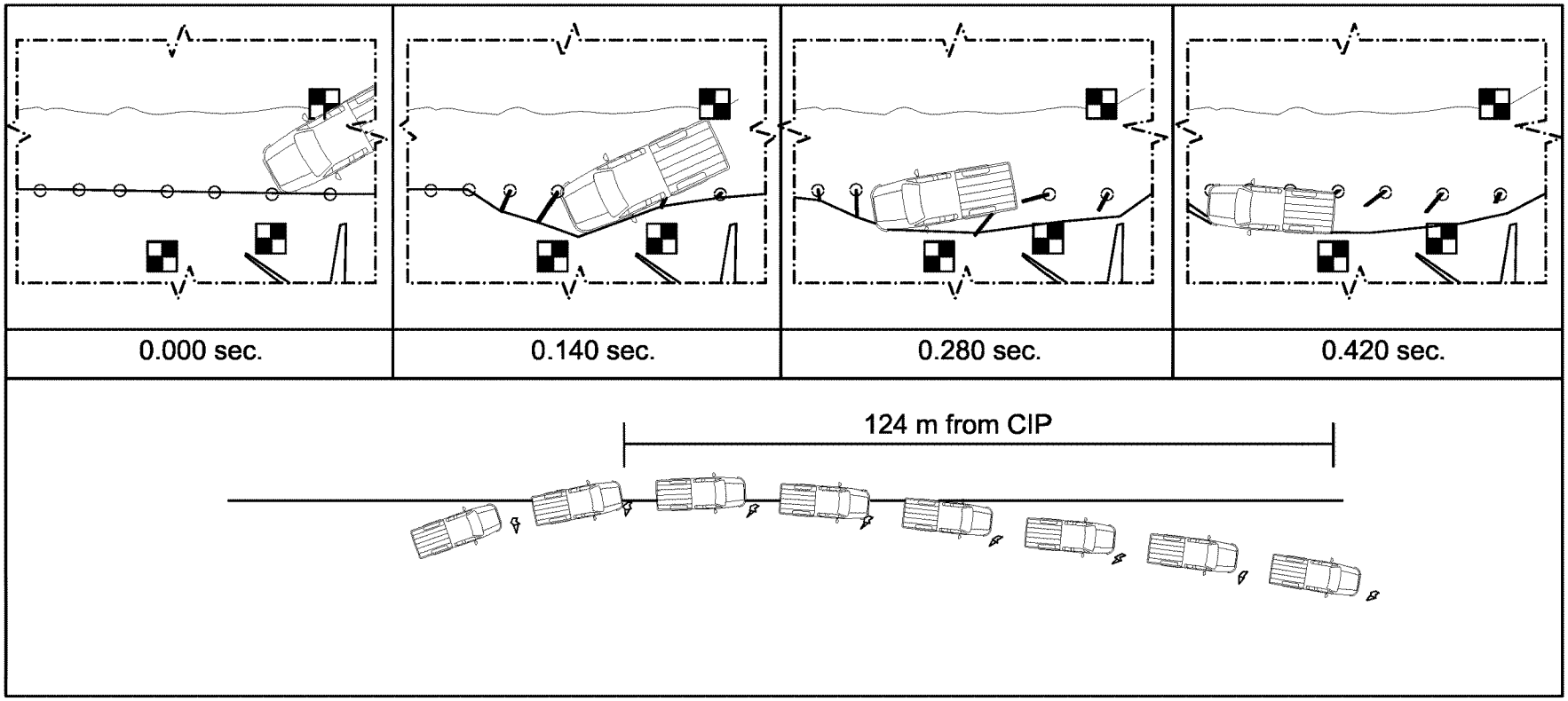
FIG. 14 shows images of the impact and vehicle path of travel in a test using a 2270 kg vehicle.

Images of the impact and vehicle path of travel for Test 4-11 are shown in FIG. 14.

Figure 15:
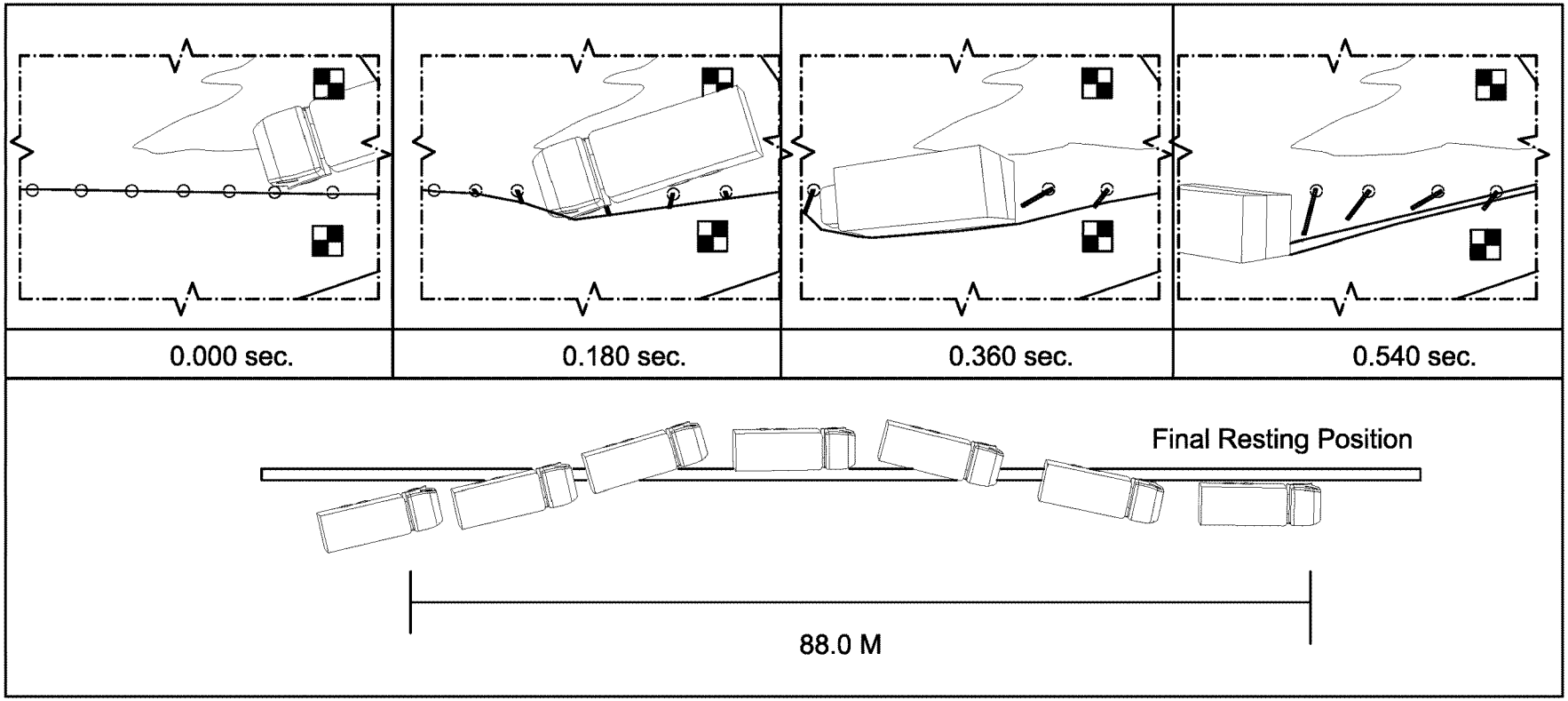
FIG. 15 shows images of the impact and vehicle path of travel in a test using a 10000 kg vehicle.

Images of the impact and vehicle path of travel for Test 4-12 are shown in FIG. 15.

Aspects of the wire rope barrier have been described by way of example only and it should be appreciated that modifications and additions may be made thereto without departing from the scope of the claims herein.

What is claimed is:

1. A wire rope barrier comprising a plurality of posts and at least one cable, each post being linked to one or more of the cable(s) via one or more hangers, wherein each hanger comprises:

(a) a cable holding portion including two parallel spaced apart U-shaped cradle portions, the U-shaped cradle portions each defining an opening oriented to enable release of the respective cable from each cradle portion in an ascendent direction, and the respective cable is seated within both of the two spaced apart U-shaped cradle portions;

(b) two legs extending from the cable holding portion, wherein distal ends of each of the two legs are received within two corresponding through-holes located on different sides of the respective post in an orientation so that each distal end has a different axis of rotation relative to the post; and when a predetermined impact force from a vehicle collision is imposed on the barrier, one or more of the hangers release the cable retained therein when at least one of the legs or a part thereof deforms and the or each said hanger at least partially detaches from its respective post.

2. The wire rope barrier as claimed in claim 1 wherein the hanger legs are of varying length compared to each other.

3. The wire rope barrier as claimed in claim 1 wherein the hanger legs attach to opposing sides of the post at different vertical heights.

4. The wire rope barrier as claimed in claim 1 wherein the hanger legs, when installed, link to opposing sides of the post.

5. The wire rope barrier as claimed in claim 1, wherein the two spaced apart U-shaped cradle portions of the cable holding portion of each hanger are shaped and oriented to define two respective cable seating regions at two spaced apart locations to engage the at least one cable about the at least two spaced apart locations along a longitudinal axis of the at least one cable with the at least one cable being seated on both of the two respective cable seating regions of the two spaced apart U-shaped cradle portions.

6. The wire rope barrier as claimed in claim 1 wherein, when a predetermined relative lateral rotation between one of the cables and at least one of the plurality of posts occurs, the cable is pried out of the cable holding portion of one of the hangers and separates from the respective post.

7. The wire rope barrier as claimed in claim 1 wherein, when a predetermined impact force is imposed on the barrier, the at least one hanger releases the cable held therein when at least one leg of the two legs or a part thereof deforms and the hanger at least partially detaches from the post.

8. The wire rope barrier as claimed in claim 7 wherein the predetermined impact force needed to cause deformation of at least one leg of the two legs or a part thereof is predetermined by selection of at least one leg of the two legs or part thereof with one or more characteristics of:

(a) a size that deforms at a predetermined impact force yet is strong enough to maintain the cable in a position on the post when not under an impact force;

(b) a material with a strength or elasticity that deforms at a predetermined impact force yet is strong enough to maintain the cable in a position on the post when not under an impact force;

(c) a shape of a weaker strength about a particular deformation region that is designed to deform at a predetermined impact force;

(d) a material treatment about a particular deformation region that is designed to fail at a predetermined impact force.

9. The wire rope barrier as claimed in claim 7 wherein, in an event of an impact on the barrier, any subsequent upward movement of the at least one cable relative to the post urges the cable holding portion of the attached respective hanger(s) to rotate.

10. The wire rope barrier as claimed in claim 7, wherein a vertical load force resistance of the respective hanger(s) prior to deformation occurring is lower than a horizontal load force resistance of the respective hanger(s) prior to deformation occurring.

11. The wire rope barrier as claimed in claim 1 wherein the hanger at least in part is an elongated shaped rod.

12. The wire rope barrier as claimed in claim 1 wherein each hanger when attached to its respective post, is able to move at least partially relative to the post to allow for varying cable orientations relative to the post orientation.

13. The wire rope barrier as claimed in claim 1 wherein each post has a plurality of through-holes in the form of slots that receive the legs of a respective hanger or a part thereof.

14. The wire rope barrier as claimed in claim 13 wherein for each post, the plurality of slots comprise one slot shaped to allow a first one of the two legs of a respective hanger to enter the slot directly into a post side and an opposing slot shaped to allow a second one of the two legs of said respective hanger to enter the slot initially in a horizontal plane and subsequently in a substantially vertical plane until reaching a final seated position in the slot.

15. The wire rope barrier as claimed in claim 13 wherein a distal end of one of the two legs is shaped to be aligned in a direction parallel and offset relative to a longitudinal axis of the cable.

16. The wire rope barrier as claimed in claim 13 wherein a distal end of one of the two legs is shaped as an inverted U-shaped hook, the U-shaped hook being perpendicular and offset relative to a longitudinal axis of the cable and at least part of a post wall beneath the slot fits within the U-shaped hook once the hanger reaches a final seated position.

17. The wire rope barrier as claimed in claim 1, wherein fitting the at least one cable to the post via the hanger can be completed by hand.

18. A method of assembling the wire rope barrier of claim 1, the method comprising:

a) installing the plurality of posts at spaced apart intervals substantially along a desired length of the barrier and aligning the at least one cable(s) with the plurality of posts along the desired length of the barrier;

b) placing the or each cable into the cable holding portion of at least one hanger for each post installed along the length of the barrier, the cable holding portion of each hanger including the two spaced-apart U-shaped cradle portions, with the respective cable being positioned within both of the two spaced apart U-shaped cradle portions;

c) attaching each hanger to the respective post to link the cable(s) to the posts; and d) tensioning the or each cable to form an assembled wire rope barrier.

19. The wire rope barrier as claimed in claim 1, wherein, each post is comprised of a first face, a second face adjacent the first face, a third face opposing the first face, and a fourth face opposite the second face, each post includes a first through-hole and a second through-hole, the first through-hole formed entirely within the first face of the post, and the second through-hole formed as a keyed pathway extending continuously across the second and third faces of the post, the first through-hole allowing a first one of the two legs of a respective hanger to enter, via the first through-hole, directly into the first face of the post, and the second through-hole allowing a second one of the two legs of said respective hanger to enter the second through-hole initially in a horizontal plane and subsequently in a substantially vertical plane until reaching a final seated position in the second through-hole.

20. The wire rope barrier as claimed in claim 1, wherein, the distal ends of each of the two legs are oriented such that when the hanger is attached to the post, the distal end of a first leg extends along a first axis, and the distal end of a second leg extends along a second axis that is perpendicular to the first axis.

21. A wire rope barrier comprising a plurality of posts and at least one cable, each post and at least one cable being linked via at least one hanger wherein the hanger comprises:

(a) a cable holding portion including two parallel spaced apart U-shaped cradle portions having the same orientation to each other and each defining an opening oriented to enable release of the respective cable from each cradle portion in an ascendent direction, the two parallel U-shaped cradle portions each including first and second sides, the first side of each U-shaped cradle portion connected by a cross bar aligned perpendicular to the U-shaped cradle portions, and the respective cable is seated within both of the two spaced apart U-shaped cradle portions;

(b) two legs extending from the second side of each U-shaped cradle portion and connected to each other solely via the cross bar and U-shaped cradle portions, wherein termini of the distal ends of each of the two legs are received within two corresponding through-holes located on different sides of the respective post, and each of the termini are spaced apart from each other in an orientation so that the distal end of a first leg of the two legs has an axis of rotation relative to the respective post and perpendicular to the axis of rotation relative to the respective post of the distal end of a second leg of the two legs.

* * * * *